United States Patent [19]

Finsterwalder et al.

[11] 4,073,115

[45] Feb. 14, 1978

[54] PROCESS FOR THE PRODUCTION OF A BRIDGE GIRDER SECTIONAL CANTILEVER CONSTRUCTION

[75] Inventors: Ulrich Finsterwalder, Munich; Otto Seidl, Neubiberg, both of Germany

[73] Assignee: Dyckerhoff & Widmann Aktiengesellschaft, Munich, Germany

[21] Appl. No.: 401,098

[22] Filed: Sept. 27, 1973

[30] Foreign Application Priority Data

Sept. 28, 1972 Germany ..... 2247609

[51] Int. Cl.[2] ..... E04G 21/14

[52] U.S. Cl. ..... 52/745; 52/747

[58] Field of Search ..... 52/223, 173, 227, 745, 52/747; 264/228; 249/131

[56] References Cited

U.S. PATENT DOCUMENTS

| | | | |
|---|---|---|---|
| 942,092 | 12/1909 | May | 249/131 |
| 2,751,776 | 6/1956 | Streblow et al. | 52/228 |
| 2,963,764 | 12/1960 | Finsterwalder | 52/223 |
| 3,022,759 | 2/1962 | McCall | 52/223 |
| 3,084,481 | 4/1963 | Silberkuhl et al. | 52/174 |
| 3,283,457 | 11/1966 | Hart | 264/228 |
| 3,367,074 | 2/1968 | Vanich | 52/223 |
| 3,570,207 | 3/1971 | Launay | 52/227 |
| 3,788,023 | 1/1974 | Macchi | 52/227 |
| 3,794,433 | 2/1974 | Schupack | 52/227 |

FOREIGN PATENT DOCUMENTS

| | | | |
|---|---|---|---|
| 642,128 | 6/1962 | Canada | 52/174 |
| 973,407 | 2/1960 | Germany | 52/223 |
| 688,155 | 3/1965 | Italy | 52/227 |

*Primary Examiner*—James L. Ridgill, Jr.

*Attorney, Agent, or Firm*—Orville N. Greene; Frank L. Durr

[57] ABSTRACT

There is disclosed a process for the production of a bridge girder system of prestressed concrete in sectional cantilever construction in which prefabricated sections comprising the whole superstructure cross-section formed as hollow boxes, are drawn tightly together in the longitudinal direction of the bridge to form a monolithically acting girder system, the process comprising the steps of arranging a plurality of bridge sections in succession in the longitudinal direction of the bridge, assembling said sections to form a set, said set of sections having been simultaneously prefabricated while separating the surfaces which are to be turned toward one another (in the subsequent incorporation of the individual sections in the bridge structure) by steel sheets, and then moving the sections into position individually so that they are held solely by means of the frictional connection produced by the prestressing between their contacting surfaces.

There is also disclosed apparatus for carrying out a process in accordance with the invention.

4 Claims, 9 Drawing Figures

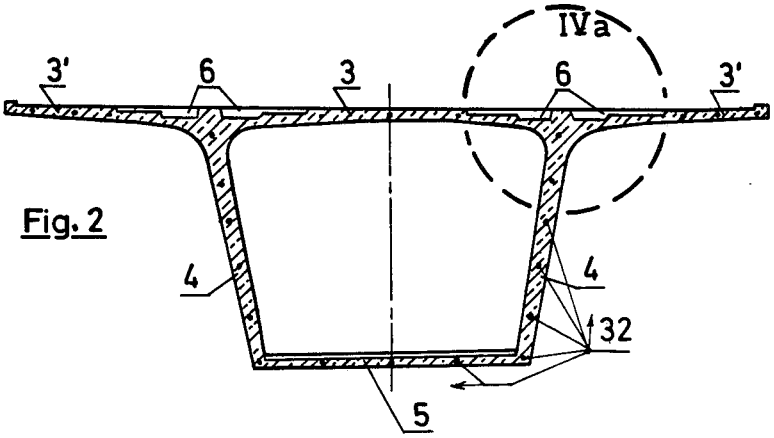
Fig. 2
Fig. 3
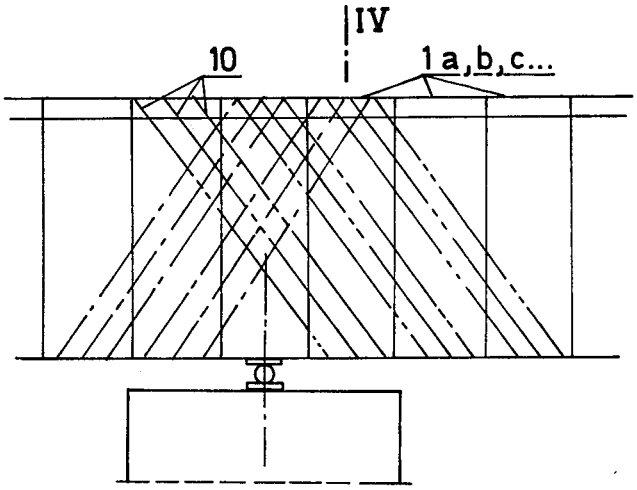

PROCESS FOR THE PRODUCTION OF A BRIDGE GIRDER SECTIONAL CANTILEVER CONSTRUCTION

FIELD OF THE INVENTION

The invention relates to a process for the production of a bridge girder system of prestressed concrete in sectional cantilever construction, in which prefabricated sections, comprising the whole superstructure cross-section formed as hollow boxes, are drawn tightly together in the longitudinal direction of the bridge to form a monolithically acting girder system.

In accordance with the invention a process is provided for the production of a bridge girder system of prestressed concrete in sectional cantilever construction in which prefabricated sections comprising the whole superstructure cross-section formed as hollow boxes, are drawn tightly together in the longitudinal direction of the bridge to form a monolithically effective girder system, said process comprising the steps of placing a plurality of bridge sections in succession in the longitudinal direction of the bridge, assembling said sections to form a set, concreting the sections simultaneously, placing said sections with surfaces facing one another and separating them with steel sheets and then moving the sections into position individually so that they are held solely by means of the frictional connection produced by the prestressing between their contacting surfaces.

German Pat. Spec. No. 973,407 discloses a method for the sectional cantilever construction of bridge girder systems in concrete, cast in situ, in which each cantilever section produced on a travelling concreting appliance is pressed after setting, by means of longitudinally-extending tensioning members against the particular section previously finished.

It is also already known to produce individual sections, comprising the whole superstructure cross-section formed as hollow boxes, in a place apart from the assembly place, by a prefabrication method, conveying them to the place of assembly, there moving them by suitable hoisting equipment and then pressing them by means of tensioning members inserted in corresponding ducts or channels, against the already finished superstructure part of the bridge.

In a known bridge produced in this manner (German Pat. Spec. No. 1,658,602) the individual sections are produced in a workshop in fixed shutterings in a cyclic process. Assembly is affected by means of an assembly device travelling on the already finished superstructure part of the bridge and projecting beyond the end point of the cantilever, from which the prefabricated sections are suspended for erection, insertion of the tensioning members and tightening. The dimensions of the individual finished components, particularly the dimensions in the direction of the longitudinal axis of the bridge, here depend on the weight of the finished components and the carrying capacity of the hoisting equipment available.

Between the joint surfaces (given a section such as to improve the transverse stress transmission) of the individual finished components, an intermediate layer of concrete was provided. Such an intermediate layer is not only disadvantageous in view of delaying the forward constructional progress, because of the time required for complete setting, which it necessitates and during which the assembly appliance is held up, but also in respect of the strength of the complete girder system, as so thin an intermediate layer at that point can hardly be as carefully incorporated, or offer the same quality as in the case of finished concrete components produced in the shop.

In a bridge produced in a similar way ("Der Bauingenieur" (('The Constructional Engineer')), 1971, vol. 2, pp. 62/63) for the purpose of ensuring an accurately fitting connection, each cantilever section was concreted adjacent to the one subsequent in the construction. Before laying each section in place its connecting surface was coated with a synthetic resin adhesive mixed with quartz sand, and placed under compressive stress. The adhesive, which had no static duty to fulfil, served for compensating irregularities in the end faces of the finished parts and for sealing the joints. Apart from the fact that certain manipulations are required for applying the adhesive, which call for an increased labor expenditure, the disadvantage exists that in the case of low temperatures the adhesive does not fully set, so that this mode of construction cannot be used at the very moment, that is to say in winter, when it is supposed to have particular advantages over the mode of construction using casting in situ.

The present invention can also be referred back to some extent to what is known as "Contact construction" (German Pat. Spec. No. 1,409,930), in which reinforced concrete prefabricated components for constructional purposes, particularly for bridge girder systems, are produced in such a way that the components which when finished are to be arranged adjacent to one another are simultaneously and continuously concreted, in such a manner that the surfaces of the finished components which in the subsequent incorporated position are turned towards one another at a joint, are separated from one another by a steel sheet. In this mode of production, the property of steel sheets coming from the rolling mills, is utilized, that is to say that even when they are not completely plane, both sides are always parallel to one another. As a result of this, after the prefabricated components are demoulded, the parts can be pushed together in such a way that the irregularities of one side surface come to lie in the corresponding irregularities of the side surface of the adjacent prefabricated component.

The sectional cantilever construction of bridges in which the forward cantilever construction is carried on without any fixed apparatus practically in the open air, necessitates a continuous check on the bridge gradients and a corresponding effecting of corrections in order to ensure that two cantilever arms growing forward towards one another from adjacent piers, also meet accurately in the centre of the bridge span. In the case of cantilever construction with in situ casting the possibility of effecting corrections exists for each cantilever section. In the case of cantilever construction using prefabricated components, this possibility only exists when, in accordance with the first of the previously-outlined building processes, concreting of the joint is effected on the spot. This, however, has the disadvantage that the operation has to be suspended while awaiting the conclusion of the setting of the mortar, by which the progress of construction is delayed. With other known processes this possibility again is still not offered, as the joint surfaces have to be pressed accurately against one another and, because of the minimum thickness of the adhesive, a compensation for the finish tolerances is not possible.

An object of the invention is to provide, in the case of a bridge construction operation of the kind to which the invention relates, the possibility of avoiding the disadvantages inherent in the known methods, and also to attain a constructionally and economically superior mode of construction in producing cantilever bridges from prefabricated components.

The invention provides a process for the production of a bridge girder system of prestressed concrete in sectional cantilever construction in which prefabricated sections, which are narrow in proportion to the whole superstructure in the longitudinal direction, are formed as hollow boxes, are drawn tightly together in the longitudinal direction of the bridge to form a monolithically effective girder system, the process comprising the steps of arranging a plurality of bridge sections in succession in the longitudinal direction of the bridge, assembling said sections to form a set, said set of sections having been prefabricated while separating the surfaces which will be turned towards one another (in the subsequent incorporation of the individual sections in the bridge structure) by steel sheets, and then moving the sections into position individually so that they are held solely by means of the frictional connection produced by the prestressing between their contacting surfaces.

It has been found, in the "contact construction" method described above, that the irregularities of the side surfaces are on the one hand so small, and on the other hand extend so continuously, that in assembling the prefabricated components at the point of incorporation, certain tolerances can be compensated by displacing the prefabricated components in the vertical and/or horizontal direction and also by rotating the same. This property attaching to the prefabricated parts of the production, is utilized in the present invention for the purpose of cantilever construction, where it offers the possibility of effecting continuous corrections in the joints between the individual cantilever sections. When effecting these corrections it has been found advantageous for the cantilever sections to be narrow in proportion to the structural height of the superstructure cross-section. In this way there is available a large number of joints and a very favourable possibility of stepwise carrying-out of the necessary corrections. As because of the multiplicity of the finished parts and joints used, the displacements or rotations occurring in each individual joint can be kept extraordinarily small, they can still remain within the permissible limits, which can further occur in the case of the ducts for passing the spanning or tensioning members through, in order to ensure a friction-free passing-through.

In the accompanying drawings:

FIG. 2 is a cross-section through the bridge superstructure;

FIG. 3 is a side elevation of the bridge superstructure showing diagrammatically the oblique tensioning members;

Figure 4A:
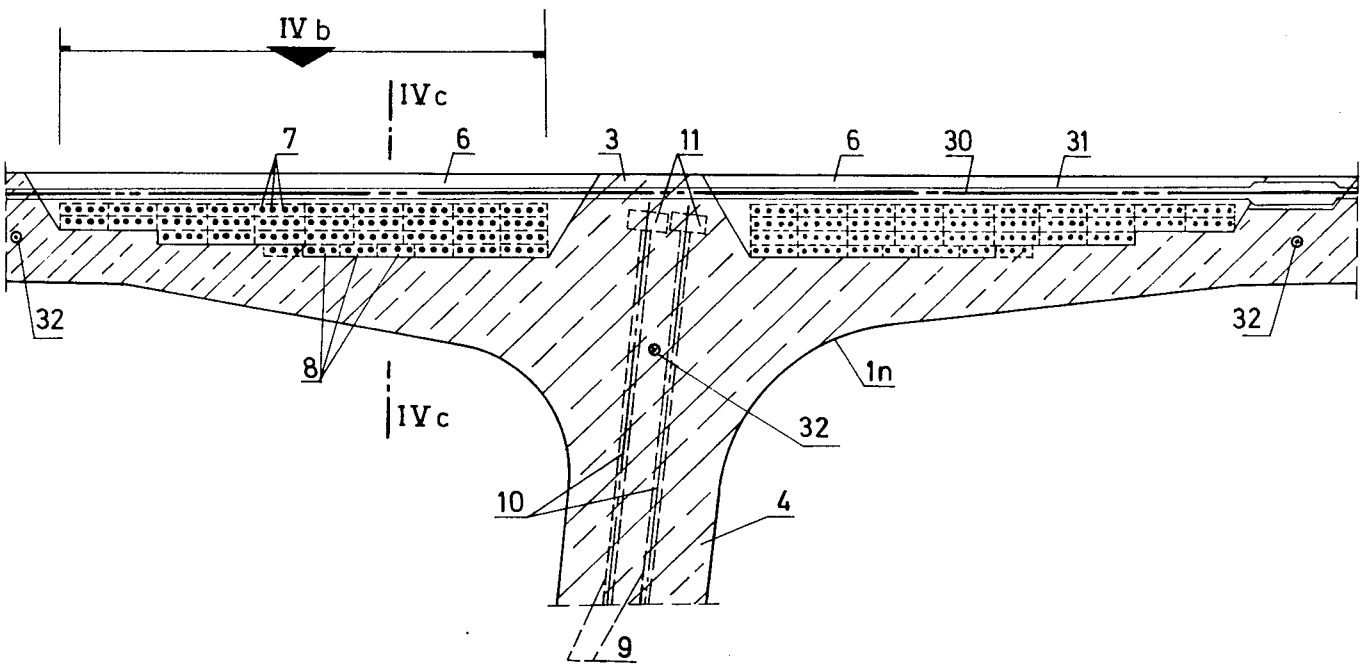
Figures 4B, 4C:
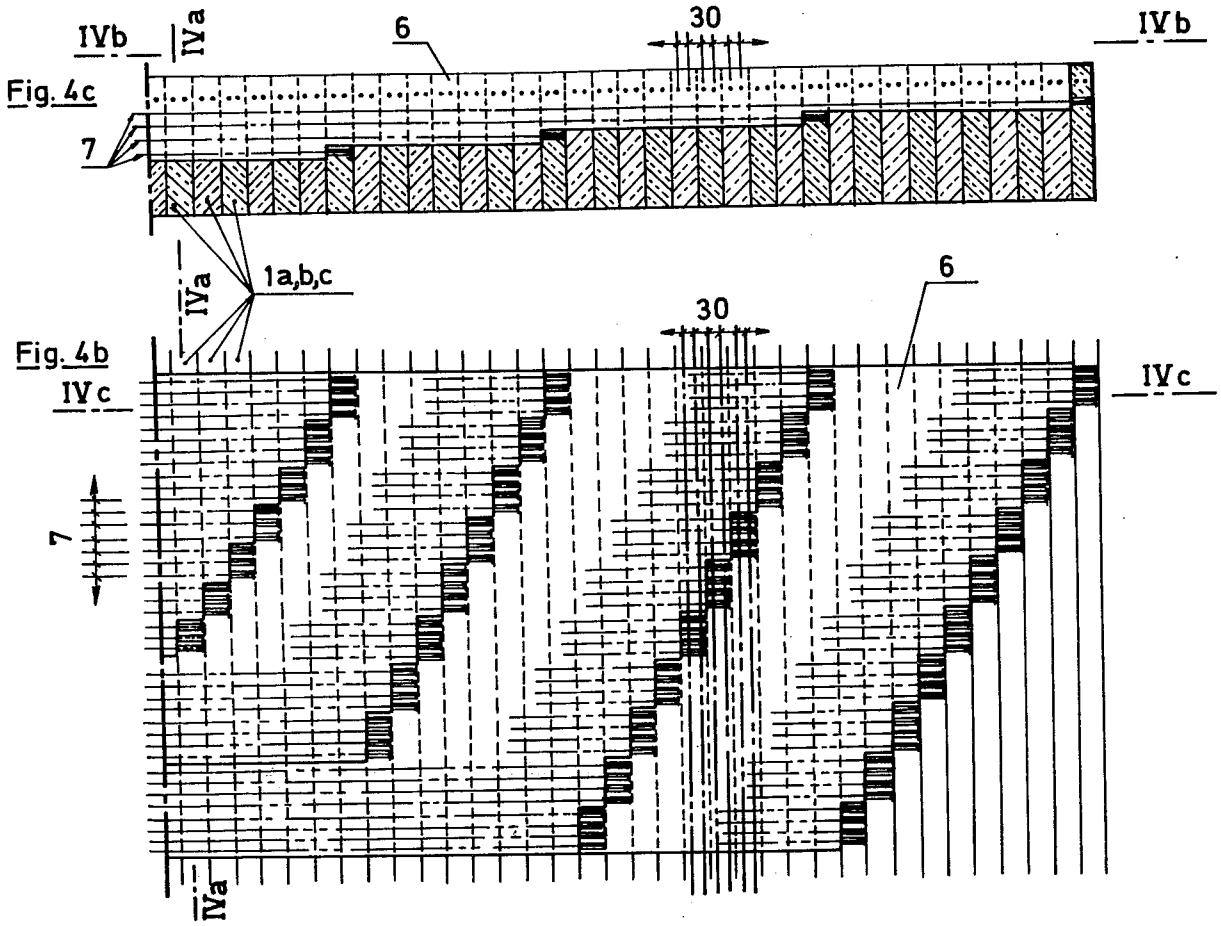
Figures 5A, 5B, 5C:
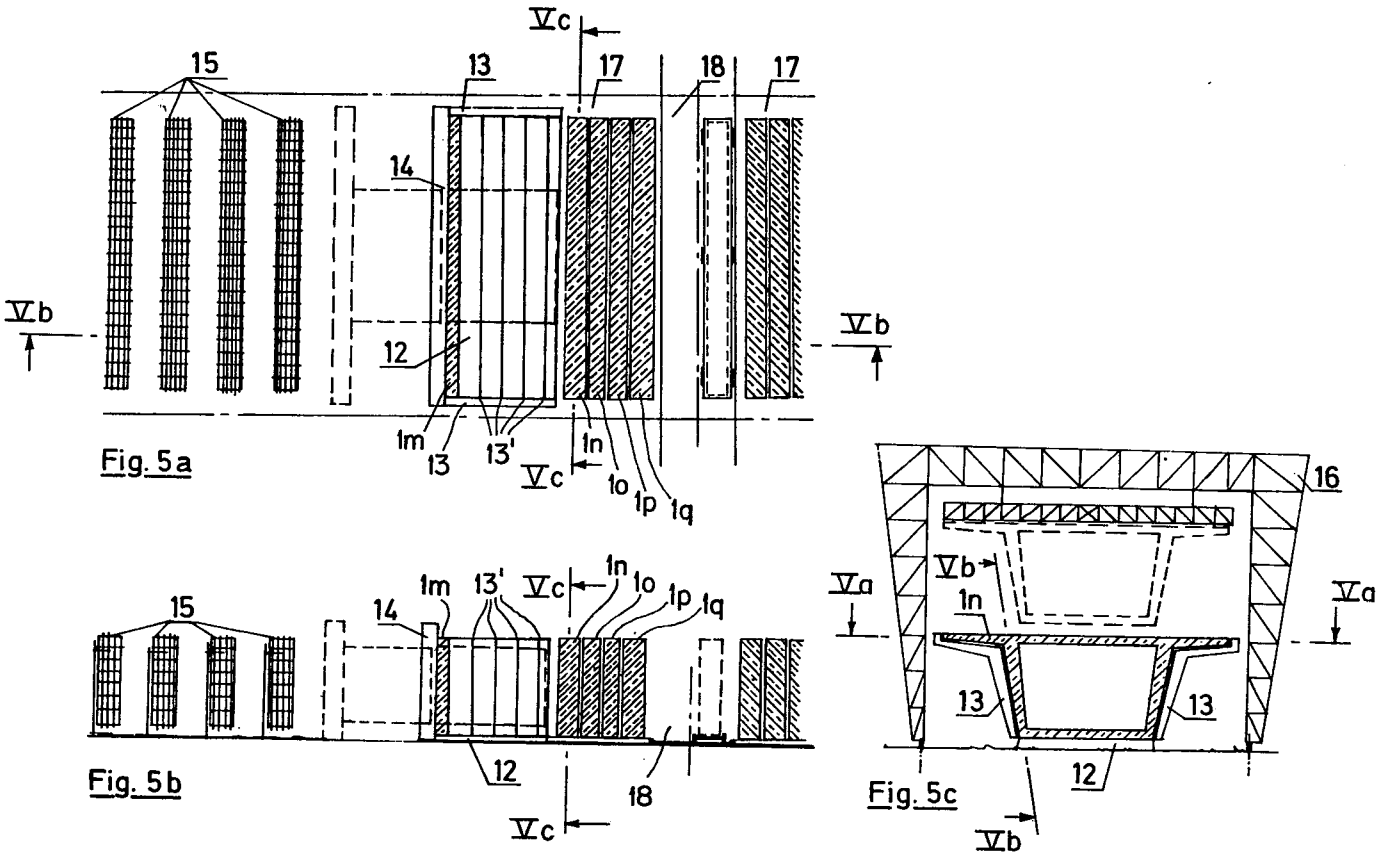

FIG. 4*a* is a section IV of the bridge cross-section on a larger scale;

FIG. 4*b* is a section of the plan view in the direction of the section IV;

FIG. 4*c* is a longitudinal section along the line IV *c*–IV *c* in FIGS. 4*b*; and FIGS. 5*a* to *c* represent diagrammatically an apparatus for producing the prefabricated components of the bridge, in plan view, in elevation and in section respectively.

In the bridge structure shown in the drawings, the superstructure 1 consists of a large number of narrow sections 1*a*, 1*b*, 1*c* etc, each covering the whole superstructure cross-section transversely in section to the longitudinal axis of the bridge. These sections, of which in what follows only one section will be further considered, are all made equal in principle. They are produced in a concrete works or in a corresponding plant on the building site, and are conveyed to the point of incorporation.

The superstructure 1 is formed as box girders with a decking 3 covering the upper deck slab, oblique main girder webs 4 and a lower base plate 5. The decking 3 is provided with lateral overhanging elements 3'.

There are disposed in the decking 3, in the zones on either side of the main girder webs 4, niches 6, in which are inserted tensioning members 7 extending in the longitudinal direction of the bridge. The tensioning members 7 are stacked lengthwise correspondingly to the anticipated distribution of bend stress. The sections 1*n* are also constructed in a similar way, so that for each group of a given length of tensioning members 7, a given niche length is obtained. The length of the corresponding niche part is limited in that, in the section 1*n* in which a group of tensioning members 7 are to be anchored, a given part 8 of the niche is fully concreted and is provided with the corresponding number of ducts, in which the tensioning members can be inserted. In the other zone of the niches, the tensioning members 7 are completely free. In addition individual longitudinal tensioning members are distributed over the cross-section.

There are further provided in the main girder webs 4 of the sections 1*n*, ducts 9 in which the tensioning members 10 for the subsequent oblique pre-stressing can be threaded. The ducts 9 are produced by die rods during the production of the sections 1*n*, which rods after the concreting, but still before the final hardening of the concrete, can be withdrawn again. The tensioning members 10 are anchored in anchorages 11.

The transverse reinforcement lies over the longitudinal reinforcement and is subsequently stressed in order to effect, in the niche concrete also, a pre-stressing. For this particular structural condition the arrangement of a slack reinforcing system under the niches is sufficient.

A building site plant for producing the sections 1*n* is represented in FIGS. 5*a* to 5*c*. Here FIG. 5*a* is a plan view of the whole apparatus, FIG. 5*b* a side elevation and FIG. 5*c* a cross-section.

In the central zone of this apparatus there is located a plane base surface 12, on either side of which outer shutterings 13 are disposed. In the base surface 12 and in the outer shutterings 13 are held the sheets which serve for separating adjacent finished parts fom one another. The inner shuttering 14 is mobile in manner known per se.

On the left hand side of the apparatus shown in FIG. 5*a*, the slack reinforcing system for the individual finished components is prefabricated in the form of reinforcing cages 15. These cages are then inserted in the outer shuttering 13, the inner shuttering 14 is moved in and the concrete applied. Afer the hardening of the finished components and the removal of the inner shuttering 14, the individual finished components are lifted off by means of a conveyor crane 16 (FIG. 5*c*) and laid intermediately on a bedding element 17 on either side of a collecting row 18. In this connection the last finished component each time is preferably only half-completed, then shifted to the position of the first, positioned, and used as starting point for a new series of finished components. In this connection the half-finished component is completed to form a whole finished component, provided with a contact sheet. The same process of operation can then be run through again.

Figure 1:
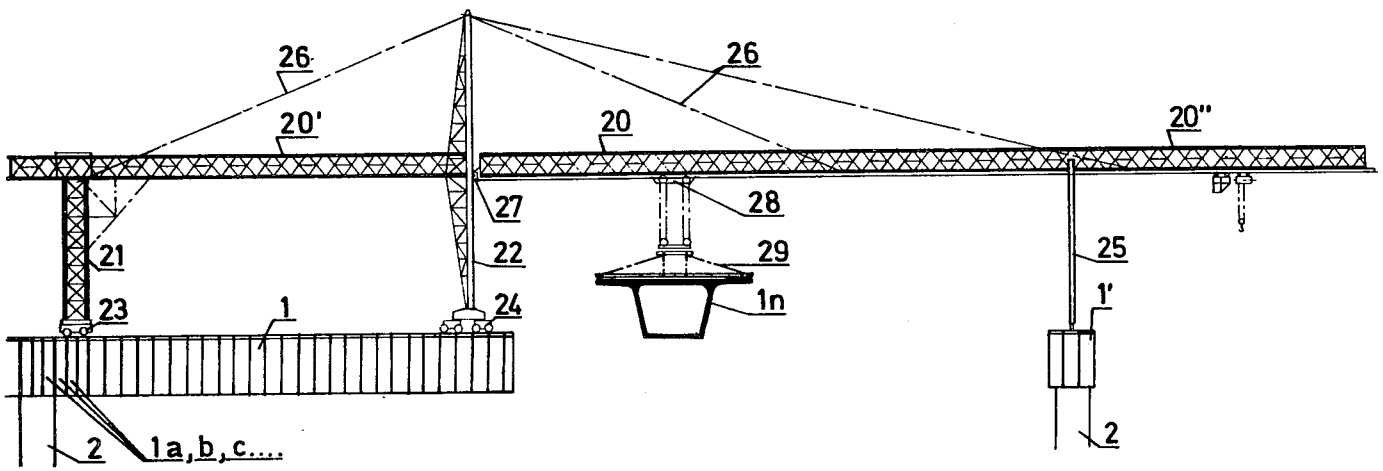
FIG. 1 is a side elevation showing a process of assembly of a bridge, according to the invention, illustrating the assembly appliance.

For assembling the sections 1*n* an auxiliary structure is used, an example of which is represented in FIG. 1. The auxiliary structure consists of a trestle girder 20, which in turn comprises two parts 20' and 20''. The trestle girder 20 is supported by means of two support members 21 and 22 via travel rollers 23 and 24 on the already finished superstructure part 1 resting on a pier 2, and is supported at its front part 20'' via a support member 25 on a pier head 1' of the next following pier 2'. The centre support member 22 takes the form of a pylon, to the apex of which guys 26 are fixed, which serve for back-staying the two parts 20' and 20'' of the trestle girder 20. The front part 20'' of the trestle girder 20 is articulately connected at 27 to the pylon, in order to make the auxiliary structure extend in a curve.

Along the underside of the front part 20'' of the trestle girder 20 there can travel a hoist 28, from each of which a section can be suspended, via a cross-member 29, in such a way as to be swivellable about a vertical axis/ By means of the hoist 28 the section 1*n* is taken off its transporting vehicle and brought into the appropriate incorporation position. There it is trued vertically and horizontally and tensioning members 7 fitted to it, and also the oblique tensioning members 10 are threaded in. Because of the special nature of the process advantageously used for producing the prefabricated components, small reciprocal movements of adjacent prefabricated components are possible in both the horizontal and vertical directions, and also rotations or twistings. In this way the necessary possibility of assembly tolerances is allowed for, ensuring the carrying out of camber, inclinations and the fitting together of adjoining cantilever arms to form a continuous system. Any slight differences in height arising therefrom at the edges of the joints do not make themselves apparent if the edges of the prefabricated components are broken or interrupted.

Immediately after the tightening up of the tensioning members 7 and 10 the hoist 28 can be relieved of its load and moved away. Thanks to the dry condition of the joints, no delay is necessary whilst waiting for the concrete to set.

Before the final concreting of the niches 6, the tensioning members for the transverse prestressing of the decking 3 are also incorporated, and these are arranged in cable ducts 31, in order to retain their longitudinal mobility after the concreting of the niches 6.

When using the method described above, no additional outlay is incurred for the production of narrow finished components and the large number of joints, as in each case a block or unit of a multiplicity of finished components, corresponding in dimensions substantially to the size of the cantilever sections hitherto employed both in the case of production in concrete cast in situ, and also in the case of prefabricated components, or can even exceed the latter dimensions, because a whole unit is produced and brought to the place of incorporation. As in each case a multiplicity of narrow sections can be concreted simultaneously, the labour outlay for the concreting and the time consumption for the setting is the same as in the case of single-piece sections of corresponding size.

A further advantage of the process described is that joint intermediate layers of any kind between the prefabricated components, can be completely dispensed with. This omission of joint intermediate layers is made possible because the friction connection between adjacent prefabricated components is sufficiently good to take up the thrust stresses arising out of the transverse stresses. This does away with the necessity of waiting for the setting to take place for the intermediate layers to be incorporated subsequently at the joint, so that the assembly equipment is available again more quickly and the progress of construction is accelerated.

For producing the longitudinal prestressing there are provided, additionally to the straight tensioning members, extending into the bridge decking and if requisite into the baseplate, in the girder webs, tensioning members, crossing the joints, for taking up the shear stresses.

This distribution of the prestressing reinforcing steel members into straight elements extending in the longitudinal direction and straight elements extending obliquely, has the advantage that the insertion of the same into prefabricated ducts does not present any difficulties, and the tensioning ducts are kept free in a simple manner by using die rods.

The tensioning members extending in the longitudinal direction of the bridge are assembled to form groups of equal lengths, arranted in niches in the upper side of the deck, their final concreting being effected subsequently.

The arrangement of the longitudinal tension members in niches in the bride deck opening upwards, has the advantage that they can be inserted freely from above in a simple manner, not abutted against one another, and need not be threaded in through narrow cavities, and in this embodiment the tensioning members of the transverse reinforcing system of the bridge decking are then arranged above the longitudinal tensioning members.

We claim:

1. The process for the cantilever production of a bridge girder system of prestressed concrete from prefabricated sections which have the hollow box cross-sectional configuration of the whole superstructure and are tightly drawn together to form a monolithically effective girder system comprising the steps of:

(a) providing a shuttering type of casting device of the cross-sectional shape of a substantial proportion of the bridge, (b) separating the casting device into a plurality of transverse sections by sheet steel as the latter comes from the rolling mill, (c) adding slack, reinforcing steel to the mold cavities and placing ducts adapted to form conduits for prestressing rods, (d) casting concrete in the shuttering device, (e) removing the hardened sections from the shuttering device, and (f) assembling the sections at the bridge structure in the same order as they were cast and matching slight irregularities in the surfaces produced by the sheet steel on one section with the facing surface of the adjacent section, (g) prestressing the assembled sections longitudinally whereby said sections are held together frictionally by the matching irregularities in the surfaces thereof.

2. The process as claimed in claim 1 wherein said top surface of said sections are formed with non-corresponding niches therein in the region of the cavities for the longitudinal prestressing rods whereby to provide space for prestressing inserted rods, subsequently fully concreting said niches.

3. The process as claimed in claim 1 wherein the hollow-box structure of said sections include side web portions, and comprising providing oblique tensioning members passing through the joints of a plurality of individual sections.

4. The process as claimed in claim 1 wherein said hollow box structure includes a top planar portion, and comprising providing said top planar portion with transverse prestressing members.

* * * * *